US006426766B1

(12) United States Patent
Shirota et al.

(10) Patent No.: US 6,426,766 B1
(45) **Date of Patent: *Jul. 30, 2002**

(54) PRINTING PROCESS, INK SET FOR USE IN SUCH PROCESS, AND PRINT AND PROCESSED ARTICLE OBTAINED THEREBY

(75) Inventors: Koromo Shirota, Inagi; Masahiro Haruta, Tokyo; Shoji Koike; Aya Takaide, both of Yokohama; Tomoya Yamamoto; Mariko Suzuki, both of Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/881,080

(22) Filed: Jun. 24, 1997

Related U.S. Application Data

(63) Continuation of application No. 08/268,556, filed on Jul. 6, 1994, now abandoned.

(30) Foreign Application Priority Data

Jul. 9, 1993 (JP) ..... 5-170462
Jul. 9, 1993 (JP) ..... 5-170473

(51) Int. Cl.[7] ..... B41J 3/407
(52) U.S. Cl. ..... 347/106
(58) Field of Search ..... 347/106, 100, 347/43, 20

(56) References Cited

U.S. PATENT DOCUMENTS

| | | | | |
|---|---|---|---|---|
| 4,702,742 A | | 10/1987 | Iwata et al. | 347/106 X |
| 4,725,849 A | | 2/1988 | Koike et al. | 347/106 |
| 4,849,770 A | | 7/1989 | Koike et al. | 347/106 X |
| 4,953,015 A | | 8/1990 | Hayasaki et al. | 358/79 |
| 4,969,951 A | | 11/1990 | Koike et al. | 347/106 X |
| 5,059,246 A | * | 10/1991 | Yamamoto | 347/100 X |
| 5,396,275 A | * | 3/1995 | Koike | 347/106 X |
| 5,818,486 A | * | 10/1998 | Koike | 347/101 |
| 6,033,066 A | | 3/2000 | Koike et al. | 347/101 |

FOREIGN PATENT DOCUMENTS

| | | | |
|---|---|---|---|
| EP | 0212655 | 3/1987 | D06P/5/00 |
| EP | 0553760 | 8/1993 | B41M/5/00 |
| EP | 0605730 | 7/1994 | D06P/3/00 |
| GB | 1 527 396 | 10/1978 | |
| JP | 54-59936 | 5/1979 | B41J/3/04 |
| JP | 61118477 | 6/1986 | C09D/11/00 |
| JP | 61-138784 | 6/1986 | |
| JP | 61-138785 | 6/1986 | |
| JP | 62-53493 | 3/1987 | |
| JP | 62243890 | 10/1987 | D06P/5/00 |
| JP | 1-156068 | 6/1989 | |
| JP | 2-68372 | 3/1990 | |
| JP | 5-209378 | 8/1993 | |
| JP | 6-57652 | 3/1994 | |

OTHER PUBLICATIONS

Color spaces FAQ, David Bourgin (Jun. 11, 2001) pp. 1–26.
Minolta USA—Spectrophotometers, CM–2002–introduction, "The Measure of Excellence".
R.W.G.Hunt, The Reproduction of Colour, fifth edition, 1995, Chapter 7 (The Colour Triangle) pp 106 and 107).
R.W.G.Hunt, The Reproduction of Colour, fifth edition, 1995, Chapter 5 (Visual Appreciation), pp. 64–67.
R.W.G.Hunt, The Reproduction of Colour, fifth edition, 1995, Chapter 8 (Colour Standards and Calculations), pp. 136–155.
Derwent Abstract (WPI) No. 87–338767 with respect to Japanese Patent Document No. 62–243890 (Oct. 24, 1987).
Patent Abstracts of Japan vol. 10, No. 310 (C–379) with respect to Japanese Patent Document No. 61–118477 (Jun. 5, 1986).
Notice of Opposition to European Patent No. 0 633 346 B1, dated Nov. 24, 1999.
Correction Letter to Notice of Opposition to European Patent No. 0 633 346 B1, dated Dec. 13, 1999.
Response Letter to Notice of Opposition of European Patent No. 0 633 346 B1, dated Mar. 17, 2000.

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

Disclosed herein is a printing process in which at least two inks are applied to a cloth according to an ink-jet system to conduct printing, which comprises at least three steps of:

(a) applying the two inks to the cloth in such a manner that at least a part of the inks overlaps each other;

(b) subjecting the cloth, to which the inks have been applied, to a heat treatment; and (c) washing the heat-treated cloth, wherein the cloth is a cloth comprising fibers dyeable with disperse dyes, and each of the inks comprises a specified coloring matter, a compound for dispersing the coloring matter and an aqueous liquid medium.

22 Claims, 3 Drawing Sheets

PRINTING PROCESS, INK SET FOR USE IN SUCH PROCESS, AND PRINT AND PROCESSED ARTICLE OBTAINED THEREBY

This application is a continuation of application Ser. No. 08/268,556, filed Jul. 6, 1994, now abandoned.

BACKGROUND OF THE INVENTION

1. Field of the Invention

The present invention relates to a process for printing a cloth by an ink-jet system, an ink set for use in such a process, and a print and a processed article obtained thereby.

2. Related Background Art

At present, textile printing is principally conducted by screen printing or roller printing. Both methods are, however, unfit for multi-kind small-quantity production and not adapted to quickly cope with the fashion of the day. Therefore, there has recently been a demand for establishment of an electronic printing system making no use of any plate.

In compliance with this demand, many textile printing processes according to an ink-jet system have been proposed. Various demands are made on such textile printing processes.

As conditions required for ink-jet textile printing, the following may be mentioned;

(1) being able to achieve sufficient color depth upon coloring of ink;

(2) being able to provide a print high in color yield of coloring matter on cloth and to conduct a waste water treatment after completion of washing with ease;

(3) causing little irregular bleeding due to color mixing between inks of different colors on cloth;

(4) being able to achieve color reproduction within a wide range; and (5) being able to always conduct stable production of prints.

In order to satisfy these requirements, the principal strategies used heretofore have been to add various additives to ink, to control shot-in ink quantity, or to subject cloth to a pretreatment.

As an ink-jet printing method for cloth, for example, a polyester fabric, on which disperse dyes are used to conduct textile printing, a method making use of disperse dyes having a sublimation temperature of 180° C. or higher is disclosed in Japanese Patent Application Laid-Open No. 61-118477. However, when textile printing is conducted with inks making use, as coloring matter, of the disperse dyes in which attention is paid to the sublimation temperature only, good coloring is achieved where the individual inks are used singly to dye, but the color depth and color tone after the dyeing, and color reproducibility upon dyeing under the same dyeing conditions, greatly vary according to the combination of dyes used where the inks of different colors are mixed on the cloth, so that the above requirements (1), (4) and (5) are often not satisfied at the same time. Therefore, such a method has been yet insufficient to achieve various color expressions.

Accordingly, it has been impossible to fully satisfy the various requirements described above, in particular, requirement (5), by the prior art only.

The extent to which the range of color reproduction of requirement (4) can be widened is also important for widespread usage of ink-jet printing. The reason is as follows. In conventional textile printing, a printing paste is prepared every color. Therefore, a great many dyes of different tones may be used freely. On the other hand, in ink-jet textile printing, various colors are produced by mixing inks on cloth. Therefore, the colors as of inks to be used are limited to several colors only.

In conventional ink-jet printing on a recording material such as paper, all colors are often brought out according to the subtractive color process by three primary colors of yellow, magenta and cyan.

However, when printing has been conducted with inks separately containing a disperse dye on a cloth composed mainly of polyester or the like according to ink-jet printing, colors in a region of from orange to scarlet, which are often used in women's garments, have been unable to be reproduced with the same tone and chroma as those in the conventional textile printing by the mere technique of a mixing yellow and magenta colors. Besides, colors of from violescent to bluish region have also been unable to be fully reproduced by the technique of mixing magenta and cyan colors.

SUMMARY OF THE INVENTION

It is therefore an object of the present invention to provide an ink-jet printing process and an ink set which can satisfy such requirements for the usual ink-jet printing as described above when conducting ink-jet printing on a cloth composed mainly of fibers dyeable with disperse dyes, can provide a print markedly wide in color reproduction range, particularly, in a region of from orange to scarlet, and can stably form images even when the conditions of dyeing treatment by heating are somewhat changed, and a print and a processed article obtained thereby.

Another object of the present invention is to provide an ink-jet printing process and an ink set which can satisfy such requirements for the usual ink-jet printing as described above when conducting ink-jet printing on a cloth composed mainly of fibers dyeable with disperse dyes, can provide a print markedly wide in color reproduction range, particularly, of from violescent to bluish region, and can stably form images even when the conditions of dyeing treatment by heating are somewhat changed, and a print and a processed article obtained thereby.

Such objects can be achieved by the present invention described below.

According to the present invention, there is thus provided a printing process in which at least two inks of orange and red colors are applied to a cloth according to an ink-jet system to conduct printing, which comprises at least three steps of:

(a) applying the two inks to the cloth in such a manner that at least a part of the inks overlaps each other;

(b) subjecting the cloth, to which the inks have been applied, to a heat treatment; and (c) washing the heat-treated cloth, wherein the cloth is a cloth comprising fibers dyeable with disperse dyes, each of the inks comprises a coloring matter, a compound for dispersing the coloring matter and an aqueous liquid medium, the orange ink comprises, as the coloring matter, at least one selected from the group consisting of C.I. Disperse Orange 13, 29, 31:1, 33, 49, 54, 55, 66, 73, 119 and 163, and the red ink comprises, as the coloring matter, at least one selected from the group consisting of C.I. Disperse Red 54, 72, 73, 86, 88, 91, 92, 93, 111, 126, 127, 134, 135, 143, 145, 152, 153, 154, 159, 164, 167:1, 177, 181, 204, 206, 207, 221, 258, 278, 283, 288, 311, 323, 343, 348 and 356 and C.I. Disperse Violet 33.

According to the present invention, there is also provided a printing process in which at least two inks of red and blue colors are applied to a cloth according to an ink-jet system to conduct printing, which comprises at least three steps of:

(a) applying the two inks to the cloth in such a manner that at least a part of the inks overlaps each other;

(b) subjecting the cloth, to which the inks have been applied, to a heat treatment; and (c) washing the heat-treated cloth, wherein the cloth is a cloth comprising fibers dyeable with disperse dyes, each of the inks comprises a coloring matter, a compound for dispersing the coloring matter and an aqueous liquid medium, the red ink comprises, as the coloring matter, at least one selected from the group consisting of C.I. Disperse Red 54, 72, 73, 86, 88, 91, 92, 93, 111, 126, 127, 134, 135, 143, 145, 152, 153, 154, 159, 164, 167:1, 177, 181, 204, 206, 207, 221, 258, 278, 283, 288, 311, 323, 343, 348 and 356 and C.I. Disperse Violet 33, and the blue ink comprises, as the coloring matter, at least one selected from the group consisting of C.I. Disperse Blue 56, 73, 113, 128, 148, 154, 158, 165, 165:1, 165:2, 183, 197, 201, 214, 224, 225, 257, 266, 267, 287, 358 and 368.

According to the present invention, there is further provided a print obtained by any one of the printing processes described above.

According to the present invention, there is still further provided an ink set suitable for use in the printing process described above, comprising at least orange and red inks.

According to the present invention, there is yet still further provided an ink set suitable for use in the printing process described above, comprising at least red and blue inks.

According to the present invention, there is yet still further provided a print which is dyed with two coloring matters of orange and red in a state that at least a part of the coloring matters overlaps each other, wherein the coloring matter of orange comprises at least one selected from the group consisting of C.I. Disperse Orange 13, 29, 31:1, 33, 49, 54, 55, 66, 73, 119 and 163, the coloring matter of red comprises at least one selected from the group consisting of C.I. Disperse Red 54, 72, 73, 86, 88, 91, 92, 93, 111, 126, 127, 134, 135, 143, 145, 152, 153, 154, 159, 164, 167:1, 177, 181, 204, 206, 207, 221, 258, 278, 283, 288, 311, 323, 343, 348 and 356 and C.I. Disperse Violet 33, and the print is obtained by printing a cloth comprising fibers dyeable with disperse dyes.

According to the present invention, there is yet still further provided a print which is dyed with two coloring matters of red and blue in a state that at least a part of the coloring matters overlaps each other, wherein the coloring matter of red comprises at least one selected from the group consisting of C.I. Disperse Red 54, 72, 73, 86, 88, 91, 92, 93, 111, 126, 127, 134, 135, 143, 145, 152, 153, 154, 159, 164, 167:1, 177, 181, 204, 206, 207, 221, 258, 278, 283, 288, 311, 323, 343, 348 and 356 and C.I. Disperse Violet 33, the coloring matter of blue comprises at least one selected from the group consisting of C.I. Disperse Blue 56, 73, 113, 128, 148, 154, 158, 165, 165:1, 165:2, 183, 197, 201, 214, 224, 225, 257, 266, 267, 287, 358 and 368, and the print is obtained by printing a cloth comprising fibers dyeable with disperse dyes.

According to the present invention, there is yet still further provided a processed article obtained by further processing any one of the prints described above.

DESCRIPTION OF THE PREFERRED EMBODIMENTS

Figure 1:
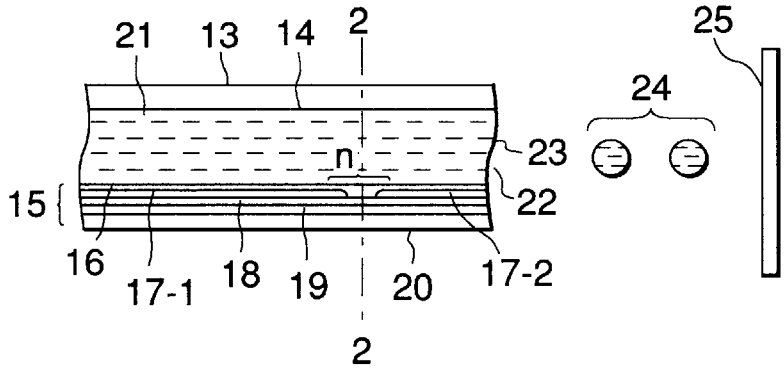
FIG. 1 is a longitudinal cross-sectional view of a head of an ink-jet printing apparatus.

The cloth useful in the practice of the present invention will be first described.

A material making up the cloth used in the present invention comprises fibers dyeable with disperse dyes. Among others, those comprising polyester, acetate and/or triacetate are preferred. Of these, those comprising polyester are particularly preferred. The above-described fibers may be used in any form of woven fabric, knitted fabric, non-woven fabric and the like.

Such a cloth preferably comprises 100% of fibers dyeable with disperse dyes. However, blended yarn fabrics or non-woven fabrics of the fibers dyeable with disperse dyes and other materials, for example, rayon, cotton, polyurethane, acrylic, nylon, wool and silk may be used as cloths for textile printing according to the present invention so far as the blending ratio of the fibers dyeable with the disperse dyes is at least 30%, preferably at least 50%.

The cloth for textile printing used in the present invention as described above may be subjected to any conventionally-known pretreatment as needed. In particular, it is preferable to treat the cloth with a solution containing urea, a water-soluble polymer, a water-soluble metal salt or the like contained in an amount of 0.01 to 20% by weight in the cloth.

Examples of the water-soluble polymer include known natural water-soluble polymers, for example, starches from corn, wheat and the like; cellulosics such as carboxymethyl cellulose, methyl cellulose and hydroxyethyl cellulose; polysaccharides such as sodium alginate, gum arabic, locust bean gum, tragacanth gum, guar gum and tamarind seed; proteins such as gelatin and casein; tannin and derivatives thereof; and lignin and derivatives thereof. Examples of synthetic water-soluble polymers include known polymers such as polyvinyl alcohol type compounds, polyethylene oxide type compounds, water-soluble acrylic polymers and water-soluble maleic anhydride polymers. Of these, the polysaccharide polymers and cellulosic polymers are preferred.

Examples of the water-soluble metal salt include compounds such as halides of alkali metals and alkaline earth metals, which form typical ionic crystals and an aqueous solution that has a pH of 4 to 10. Representative examples of such compounds include NaCl, $Na_2SO_4$, KCl and $CH_3COONa$ for alkali metals, and $CaCl_2$ and $MgCl_2$ for alkaline earth metals. Of these, salts of Na, K and Ca are preferred.

The coloring matters of orange and red, by which an aspect of the present invention is characterized, and which are contained in the inks according to the present invention, will next be described.

According to the subtractive color process in which a color is brought out by yellow, magenta and cyan, hues of from orange to scarlet can be covered by separately controlling two inks of yellow and magenta colors.

When orange and scarlet high in lightness and chroma are intended to be brought out in a region particularly faint in color depth, such colors are, however, difficult to be brought out by the subtractive color process. It is therefore essential to use an ink containing a coloring matter of orange, which has a narrow absorption spectrum, a main peak of which appears at 450 to 500 nm.

The same may be said of the coloring matters of red and blue, by which another aspect of the present invention is characterized, and which are contained in the inks according to the present invention.

According to the subtractive color process in which a color is brought out by yellow, magenta and cyan, hues of from violet to blue can be covered by separately controlling two inks of magenta and cyan colors.

When violet high in chroma, and light blue, marine blue and the like are intended to be brought out in a region faint in color depth, such colors are, however, difficult to be brought out by the subtractive color process. It is therefore particularly essential to use an ink containing a coloring matter of blue, which is more reddish and deeper than cyan.

As these coloring matters of orange and blue, disperse dyes having hues of orange and blue, respectively, are used in the present invention. However, such coloring matters cannot be selected simply from hues, but are extremely limited from the viewpoint of dyeing properties, ejection properties and the like.

The present inventors have prepared inks separately containing various kinds of disperse dyes and found that when these inks are mixed on the above-described cloth according to an ink-jet printing system, the color depth and color tone after dyeing, and color reproducibility upon dyeing under the same dyeing conditions, greatly vary according to the combination of dyes used compared with the conventional textile printing. This phenomenon has been particularly marked when using a dyeing treatment by a high-temperature (HT) steaming process or a thermosol process.

In the past, it has also been known that when polyester is intended to be dyed in one bath by "dip dyeing" or the like using two kinds of disperse dyes, the color depth may rarely vary according to the affinity between these dyes. This is said to be attributed to the structure that these dyes show in water (whether they are separated from or bonded to each other) ["Kaisetsu Senryo Kagaku (Exposition: Dyestuff Chemistry)", Shikisen-sha]. However, since this is a problem peculiar to "dip dyeing", this problem has been scarcely discussed in conventional textile printing.

In textile printing by ink-jet printing, however, the variation depending upon the combination of dyes has become more noticeable than in "dip dyeing".

The reason for this is not clear, but is considered to be attributed to the fact that in a process such as ink-jet printing in which ink droplets are successively applied to a cloth, the absolute amount of dyes applied is small and expression is made by dots, so that the variation depending upon the combination of dyes is manifested more clearly than conventional dip dyeing.

The present inventors have carried out an extensive investigation in view of the above problem. As a result, it has been found that when very limited coloring matters, which will be described subsequently, are used, the color depth and color tone after dyeing do not vary even in any combination of such coloring matters, color reproducibility after dyeing is also very stable, and the color reproduction range is markedly widened in a orange to scarlet region or in a violescent to bluish region.

From the above, the coloring matters usable in the present invention are limited to the following coloring matters.

As a coloring matter contained in the orange ink, at least one selected from the group consisting of C.I. Disperse Orange 13, 29, 31:1, 33, 49, 54, 55, 66, 73, 119 and 163 is preferably used. Of these, C.I. Disperse orange 29, 49 and 73 are particularly preferably used.

As a coloring matter contained in the red ink, at least one selected from the group consisting of C.I. Disperse Red 54, 72, 73, 86, 88, 91, 92, 93, 111, 126, 127, 134, 135, 143, 145, 152, 153, 154, 159, 164, 167:1, 177, 181, 204, 206, 207, 221, 258, 278, 283, 288, 311, 323, 343, 348 and 356 and C.I. Disperse Violet 33 is preferably used. It is more preferable to contain at least one selected from the group consisting of C.I. Disperse Red 86, 88, 92, 126, 135, 145, 152, 159, 177, 181, 206, 283 and 348.

As a coloring matter contained in the blue ink, at least one selected from the group consisting of C.I. Disperse Blue 56, 73, 113, 128, 148, 154, 158, 165, 165:1, 165:2, 183, 197, 201, 214, 224, 225, 257, 266, 267, 287, 358 and 368 is preferably used. It is more preferable to contain at least one selected from the group consisting of C.I. Disperse Blue 56, 73, 128, 154, 165, 183, 201, 214, 224, 257, 266, 267, 287 and 368.

Each of the inks according to the present invention contains at least one of its corresponding coloring matters. The total content of the coloring matters is within a range of from 1 to 25% by weight, preferably from 1.5 to 20% by weight, more preferably from 2 to 15% by weight based on the total weight of the ink.

The ink according to the present invention comprises at least the above-described coloring matter, a compound for dispersing such a coloring matter and an aqueous liquid medium.

As the compound for dispersing the coloring matter, may be used so-called dispersing agents, surfactants, resins and the like.

As the dispersing agents and surfactants, may be used both anionic and nonionic types. Examples of the anionic type include fatty acid salts, alkylsulfates, alkylbenzene sulfonates, alkylnaphthalene sulfonates, dialkylsulfosuccinates, salts of alkyl phosphates, naphthalenesulfonic acid-formalin condensates, polyoxyethylene alkylsulfates and substituted derivatives thereof. Examples of the nonionic type include polyoxyethylene alkyl ethers, polyoxyethylene alkyl phenyl ethers, polyoxyethylene fatty acid esters, sorbitan fatty acid esters, polyoxyethylene sorbitan fatty acid esters, polyoxyethylene alkylamines, glycerol fatty acid esters, oxyethylene-oxypropylene block copolymers and substituted derivatives thereof.

Examples of the resinous dispersing agents include block copolymers, random copolymers and graft copolymers composed of at least two monomers (at least one of which is a hydrophilic monomer) selected from styrene and derivatives thereof, vinylnaphthalene and derivatives thereof, aliphatic alcohol esters of α,β-ethylenically unsaturated carboxylic acids, acrylic acid and derivatives thereof, maleic acid and derivatives thereof, itaconic acid and derivatives thereof, fumaric acid and derivatives thereof, vinyl acetate, vinyl alcohol, vinylpyrrolidone, acrylamide, and derivatives thereof, and salts of these copolymers. These resins may preferably be alkali-soluble resins which are soluble in an aqueous solution of a base.

The inks according to the present invention further comprise an aqueous liquid medium, and water which is an essential component of the aqueous liquid medium is contained within a range of from 10 to 93% by weight, preferably from 25 to 87% by weight, more preferably from 30 to 82% by weight based on the total weight of the ink.

The aqueous liquid medium preferably comprises at least one organic solvent in combination with water.

Examples of the organic solvent include ketones and keto-alcohols such as acetone and diacetone alcohol; ethers such as tetrahydrofuran and dioxane; addition polymers of oxyethylene or oxypropylene, such as diethylene glycol, triethylene glycol, tetraethylene glycol, dipropylene glycol, tripropylene glycol, polyethylene glycol, polypropylene glycol and the like; alkylene glycols the alkylene moiety of which has 2 to 6 carbon atoms, such as ethylene glycol, propylene glycol, trimethylene glycol, butylene glycol and hexylene glycol; thiodiglycol; glycerol and 1,2,6-hexanetriol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; lower dialkyl ethers of polyhydric alcohols, such as triethylene glycol dimethyl (or diethyl) ether and tetraethylene glycol dimethyl (or diethyl) ether; sulfolane; N-methyl-2-pyrrolidone; 1,3-dimethyl-2-imidazolidinone; and the like.

The medium components as described above may be used either singly or in any combination thereof if used in combination with water. However, most preferable compositions of the liquid media are those comprising at least one polyhydric alcohol. Among others, a single solvent of thiodiglycol or diethylene glycol, or a mixed solvent system of diethylene glycol and thiodiglycol is particularly preferred.

The content of the water-soluble organic solvents as described above is generally within a range of from 5 to 60% by weight, preferably from 5 to 50% by weight based on the total weight of the ink.

The principal components of the inks according to the present invention are as described above. However, as other ingredients for the aqueous liquid medium, may be added various kinds of known viscosity modifiers, surface tension modifiers, optical whitening agents, antifoaming agents and the like as needed. Specific examples thereof include viscosity modifiers such as polyvinyl alcohol, cellulosics and water-soluble resins; surface tension modifiers such as diethanolamine and triethanolamine; pH adjustors according to buffer solutions; mildewproofing agents; and the like.

In addition, various kinds of dispersing agents, surfactants and/or the like may be optionally added as an ingredient for the ink for purposes other than the dispersion of the dye.

The inks according to the present invention can be prepared from the coloring matters, the compounds for dispersing the coloring matters, the solvents, water and other additives using the conventionally-known dispersing method or mixing method.

In the printing process according to the present invention, droplets of the above-described inks are applied to the above-described cloth by an ink-jet system to form a color-mixed portion with at least two inks of different colors.

In this case, the total amount of individual coloring matters applied in the color-mixed portion is within a range of from 0.01 to 1 mg/cm$^2$, preferably from 0.015 to 0.6 mg/cm$^2$, more preferably from 0.02 to 0.4 mg/cm$^2$. This amount can be determined by actually measuring the amount of the inks ejected and the concentration of the coloring matters in the inks. If the amount of the coloring matters applied is less than 0.01 mg/cm$^2$, coloring at high color depth is difficult to achieve, so that the effects of the present invention are made unclear. If the amount of the coloring matters applied exceeds 1 mg/cm$^2$, effects of improved color depth, color reproduction range, dyeing stability and the like are not markedly recognized.

As the ink-jet system used for such ink-jet printing, may be used any conventionally-known ink-jet recording system. However, the method described in, for example, Japanese Patent Application Laid-Open No. 54-59936, in which thermal energy is applied to an ink so as to undergo rapid volume change, and the ink is ejected from a nozzle by the force caused by this change of state, i.e., a bubble jet system, is the most effective method.

The reason is believed to be that if a recording head equipped with a plurality of nozzles is used, the above system is narrow in scattering of ejection velocities of the ink among individual nozzles, and the ejection velocities are summarized within a range of from 5 to 20 m/sec, and so the degree of penetration of ink droplets into a cloth at the time the ink containing a disperse dye impacts the cloth at this velocity becomes optimum.

According to the present invention, neither deposition of foreign matter on a heating head nor disconnection occurs even if printing is conducted continuously for a long period of time by such a system. Therefore, the printing can be conducted stably.

As conditions under which a particularly good effect can be achieved by such an ink-jet system, it is preferred that an ejected ink droplet be within a range of from 20 to 200 pl, the shot-in ink quantity be within a range of from 4 to 40 nl/mm$^2$, the drive frequency be at least 1.5 kHz, and the head temperature be within a range of from 35 to 60° C.

The inks applied onto the cloth in the above-described manner only adhere to the cloth in this state. Accordingly, the cloth must be subsequently subjected to a dyeing treatment in which the coloring matter in each ink is fixed to the fibers, and a treatment for removing undyed coloring matter. Such dyeing and removal of the undyed coloring matter may be conducted in accordance with the conventionally known methods.

Among others, an HT steaming process or thermosol process may preferably be used as the dyeing method. In the case of the HT steaming process, the treatment may preferably be conducted under conditions of 140 to 180° C. and 2 to 30 minutes, more preferably under conditions of 160 to 180° C. and 6 to 8 minutes. In the case of the thermosol process, the treatment may preferably be conducted under conditions of 160 to 210° C. and 10 seconds to 5 minutes, more preferably under conditions of 180 to 210° C. and 20 seconds to 2 minutes.

Incidentally, the thus-obtained print can be cut into desired sizes as needed, and the cut pieces can then be subjected to processes required to obtain final processed articles, such as sewing, bonding and/or welding, thereby obtaining the processed articles such as neckties or handkerchiefs.

As an illustrative example of an apparatus, which is suitable for use in conducting textile printing using the inks according to the present invention, may be mentioned an apparatus in which thermal energy corresponding to recording signals is applied to an ink within a recording head, and ink droplets are generated in accordance with the thermal energy. Such an apparatus will hereinafter be described.

Figure 2:
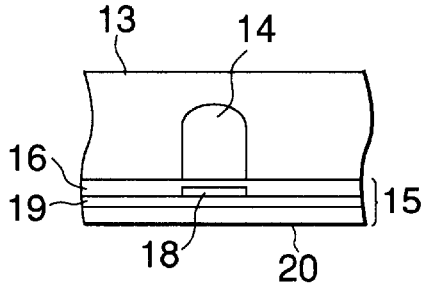
FIG. 2 is a transverse cross-sectional view of the head of the ink-jet printing apparatus.
Figure 3:
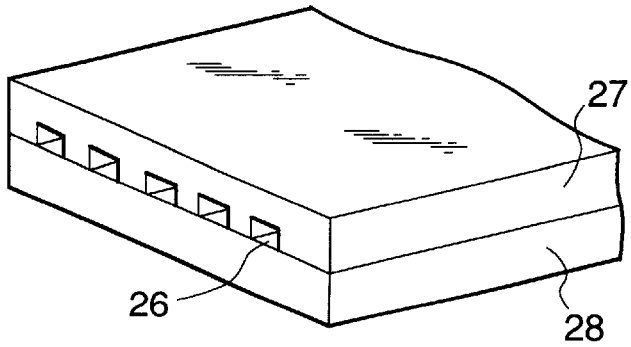
FIG. 3 is a perspective view of the appearance of a multi-head which is an array of such heads as shown in FIG. 1.

Examples of the construction of a head, which is a main component of such an apparatus, are illustrated in FIGS. 1, 2 and 3.

A head 13 is formed by bonding a glass, ceramic or plastic plate or the like having a groove 14 through which ink is passed, to a heating head 15 used in thermal recording (the drawing shows a head, to which, however, the example is not limited). The heating head 15 is composed of a protective film 16 formed of silicon oxide or the like, aluminum electrodes 17-1 and 17-2, a heating resistor layer 18 formed of nichrome or the like, a heat accumulating layer 19, and a substrate 20 made of alumina or the like having a good heat radiating property.

An ink 21 comes up to an ejection orifice 22 (a minute opening) and forms a meniscus 23 owing to a pressure P.

Now, upon application of electric signals to the electrodes 17-1, 17-2, the heating head 15 rapidly generates heat at the region shown by n to form bubbles in the ink 21 which is in contact with this region. The meniscus 23 of the ink is projected by the action of the pressure thus produced, and the ink 21 is ejected in the form of printing droplets 24 from the orifice 22 to a cloth 25 used in the present invention. FIG. 3 illustrates an appearance of a multi-head composed of an array of a number of heads as shown in FIG. 1. The multi-head is formed by closely bonding a glass plate 27 having a number of grooves 26 to a heating head 28 similar to the heating head illustrated in FIG. 1. Incidentally, FIG. 1 is a cross-sectional view of a head taken along a flow path of the ink, and FIG. 2 is a cross-sectional view taken along line 2—2 of FIG. 1.

Figure 4:
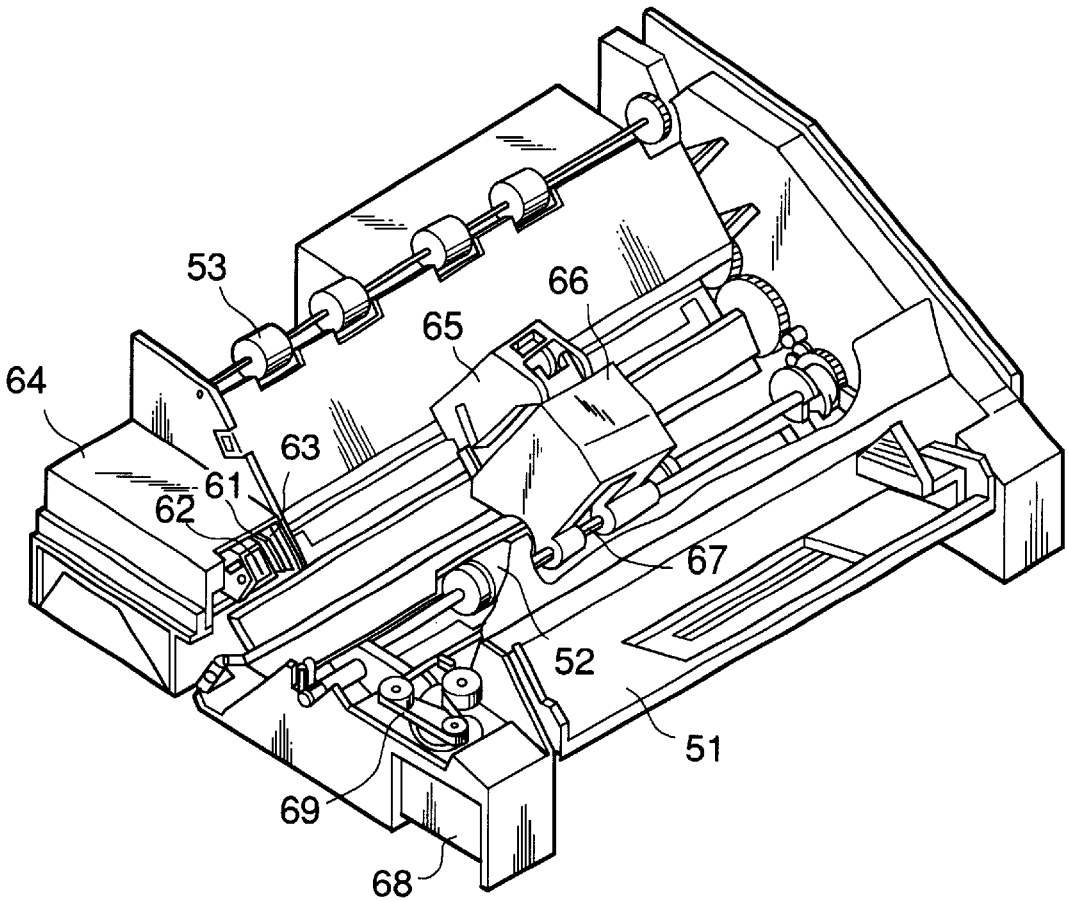
FIG. 4 is a perspective view of an illustrative ink-jet printing apparatus.

FIG. 4 illustrates an example of an ink-jet printing apparatus into which such a head has been incorporated.

In FIG. 4, reference numeral 61 designates a blade serving as a wiping member, one end of which is a stationary end held by a blade-holding member to form a cantilever. The blade 61 is provided at the position adjacent to the region in which a printing head operates, and in this embodiment, is held in such a form that it protrudes to the course through which the printing head is moved. Reference numeral 62 indicates a cap, which is provided at the home position adjacent to the blade 61, and is so constituted that it moves in the direction perpendicular to the direction in which the printing head is moved and comes into contact with the face of ejection openings to cap it. Reference numeral 63 denotes an absorbing member provided adjoiningly to the blade 61 and, similar to the blade 61, held in such a form that it protrudes to the course through which the printing head is moved. The above-described blade 61, cap 62 and absorbing member 63 constitute an ejection-recovery portion 64 for the printing head, where the blade 61 and absorbing member 63 remove off water, dust and/or the like from the face of the ink-ejecting openings.

Reference numeral 65 designates the printing head having an ejection-energy-generating means and serving to eject the ink onto the cloth set in an opposing relation with the ejection opening face provided with ejection openings to conduct printing. Reference numeral 66 indicates a carriage on which the printing head 65 is mounted so that the printing head 65 can be moved. The carriage 66 is slidably interlocked with a guide rod 67 and is connected (not illustrated) at its part to a belt 69 driven by a motor 68. Thus, the carriage 66 can be moved along the guide rod 67 and hence, the printing head 65 can be moved from a printing region to a region adjacent thereto.

Reference numerals 51 and 52 denote a cloth feeding part from which the cloths are separately inserted, and cloth feed rollers driven by a motor (not illustrated), respectively. With such construction, the cloth is fed to the position opposite to the ejection opening face of the printing head, and discharged from a cloth discharge section provided with cloth discharge rollers 53 with the progress of printing.

In the above construction, the cap 62 in the head recovery portion 64 is receded from the moving course of the printing head 65 when the printing head 65 is returned to its home position, for example, after completion of printing, and the blade 61 remains protruded to the moving course. As a result, the ejection opening face of the printing head 65 is wiped. When the cap 62 comes into contact with the ejection opening face of the printing head 65 to cap it, the cap 62 is moved so as to protrude to the moving course of the printing head.

When the printing head 65 is moved from its home position to the position at which printing is started, the cap 62 and the blade 61 are at the same positions as the positions upon the wiping as described above. As a result, the ejection opening face of the printing head 65 is also wiped at the time of this movement.

The above movement of the printing head to its home position is made not only when the printing is completed or the printing head is recovered for ejection, but also when the printing head is moved between printing regions for the purpose of printing, during which it is moved to the home position adjacent to each printing region at given intervals, where the ejection opening face is wiped in accordance with this movement.

Figure 5:
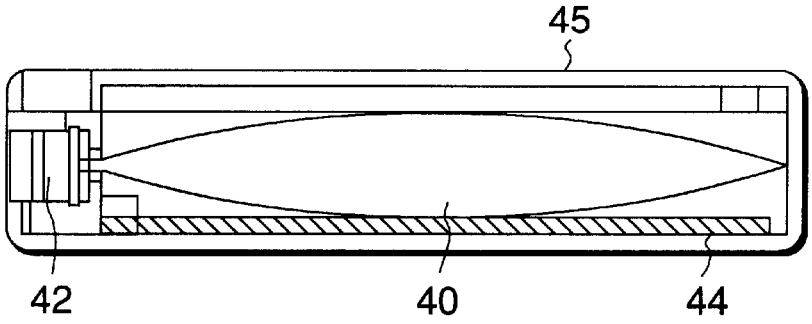
FIG. 5 is a longitudinal cross-sectional view of an ink cartridge.

FIG. 5 illustrates an exemplary ink cartridge in which an ink to be fed to the head through an ink-feeding member, for example, a tube is contained. Here, reference numeral 40 designates an ink container portion containing the ink to be fed, as exemplified by a bag for the ink. One end thereof is provided with a stopper 42 made of rubber. A needle (not illustrated) may be inserted into this stopper 42 so that the ink in the bag 40 for the ink can be fed to the head. Reference numeral 44 indicates an ink-absorbing member for receiving a waste ink. In this invention, it is preferable that the ink container portion be formed of a polyolefin, in particular, polyethylene, at its surface with which the ink comes into contact. The ink-jet printing apparatus used in the present invention is not limited to the apparatus as described above in which the head and the ink cartridge are separately provided. Therefore, a device in which these members are integrally formed as shown in FIG. 6 can also be preferably used.

Figure 6:
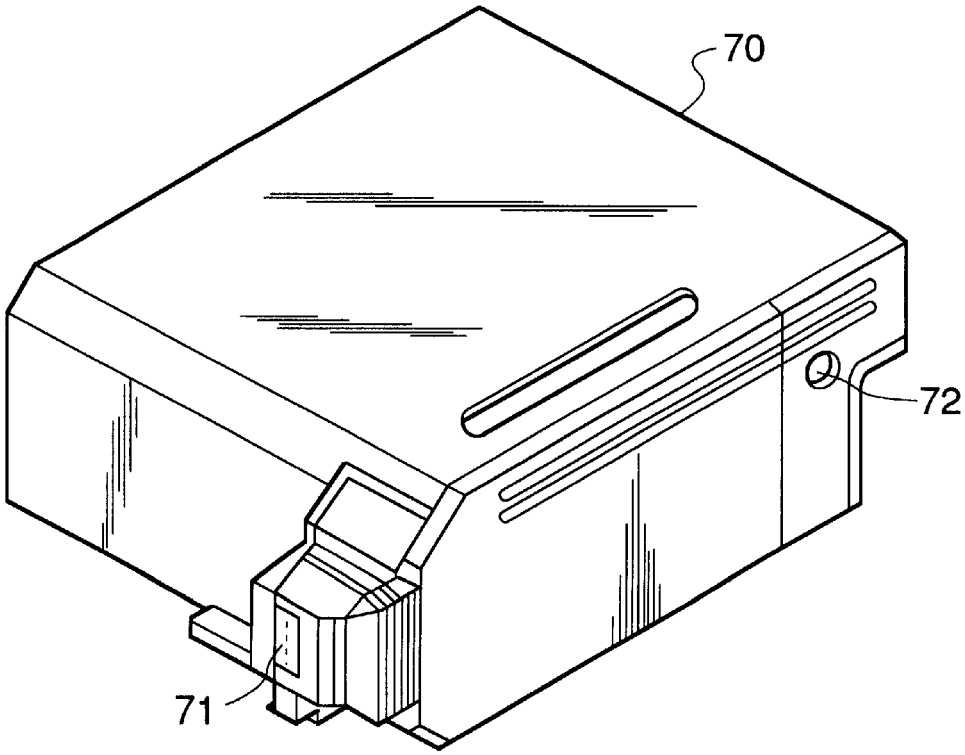
FIG. 6 is a perspective view of a printing unit.

In FIG. 6, reference numeral 70 designates a printing unit, in the interior of which an ink container portion containing an ink, for example, an ink-absorbing member, is contained. The printing unit 70 is so constructed that the ink in such an ink-absorbing member is ejected in the form of ink droplets through a head 71 having a plurality of orifices. In the present invention, polyurethane is preferably used as a material for the ink-absorbing member. Reference numeral 72 indicates an air passage for communicating the interior of the printing unit with the atmosphere. This printing unit 70 can be used in place of the printing head shown in FIG. 4, and is detachably installed on the carriage 66.

The present invention may be applied to office uses, but is particularly suitable for industrial uses other than office uses.

The present invention will hereinafter be described more specifically by the following Examples and Comparative Examples. Incidentally, all designations of "part" or "parts" and "%" as will be used in the following examples mean part or parts by weight and % by weight unless expressly noted.

EXAMPLE 1

Preparation of Dye Dispersions I and II

| | |
|---|---|
| Sodium polyoxyethylene alkyl ether sulfate | 5 parts |
| Deionized water | 75 parts |
| Diethylene glycol | 5 parts |

The above components were mixed into a solution. To portions of this solution, were separately added 15 parts of the following disperse dyes to premix them for 30 minutes. Thereafter, the resulting premixes were subjected to a dispersion treatment under the following conditions:

Disperse dye: C.I. Disperse Orange 29 (for Dye Dispersion I) C.I. Disperse Red 283 (for Dye Dispersion II)

Dispersing machine: Sand Grinder (manufactured by Igarashi Kikai K.K.)

Grinding medium: zirconium beads (diameter: 1 mm)

Packing rate of the grinding medium: 50% (by volume)

Grinding time: 3 hours.

The dispersions were further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersions I and II.

Preparation of Inks A and B

| | |
|---|---|
| Dye Dispersion I or II described above | 40 parts |
| Thiodiglycol | 24 parts |
| Diethylene glycol | 11 parts |
| Deionized water | 25 parts |

All the above respective components were mixed, and the resulting mixtures were adjusted to pH 5 to 7 with acetic acid, thereby preparing Inks A and B.

A 100% polyester woven fabric was immersed in a treatment solution (urea: 10%, sodium arginate: 2%, water 88%) in advance, squeezed to a pickup of 30% and then dried.

Inks A and B obtained in the above-described manner were charged in a Color Bubble Jet Printer BJC820 (trade name, manufactured by Canon Inc.) to print on this woven fabric, thereby preparing the following 24 print patches each having a size of 2×4 cm.

Single-color Print Patches

Patches separately printed with Ink A in shot-in ink quantities of 2, 4, 6 and 8 nl/mm$^2$; and Patches separately printed with Ink B in shot-in ink quantities of 2, 4, 6 and 8 nl/mm$^2$.

Mixed-color Print Patches

Patches printed with Inks A and B in such a manner that the inks overlap each other in all combinations of the above shot-in ink quantities (for example, a patch printed with Inks A and B, both, in shot-in ink quantities of 2 nl/mm$^2$, a patch printed with Inks A and B, respectively, in shot-in ink quantities of 4 nl/mm$^2$ and 2 nl/mm$^2$, etc.; 16 print patches in total).

The thus-obtained print patches were then fixed by a steaming treatment at 160° C. for 6 to 8 minutes. Thereafter, these patches were washed with a neutral detergent to evaluate them in color reproduction range in a region of from orange to scarlet and coloring stability. As a result, coloring in the region of from orange to scarlet was good, and coloring stability in the color-mixed portions was also good as shown in Table 1.

EXAMPLE 2

Preparation of Dye Dispersions III and IV

| | |
|---|---|
| Sodium lignosulfonate | 2 parts |
| Deionized water | 73 parts |
| Diethylene glycol | 15 parts |

The above components were mixed into a solution. To portions of this solution, were separately added 10 parts of the following disperse dyes to premix them for 30 minutes. Thereafter, the resulting premixes were subjected to a dispersion treatment under the following conditions:

Disperse dye: C.I. Disperse Orange 49 (for Dye Dispersion III) C.I. Disperse Red 145 (for Dye Dispersion IV)

Dispersing machine: Sand Grinder (manufactured by Igarashi Kikai K.K.)

Grinding medium: glass beads (diameter: 0.5 mm)

Packing rate of the grinding medium: 70% (by volume)

Grinding time: 3 hours.

The dispersions were further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersions III and IV.

Preparation of Inks C and D

| | |
|---|---|
| Dye Dispersion III or IV described above | 30 parts |
| Thiodiglycol | 25 parts |
| Tetraethylene glycol dimethyl ether | 5 parts |
| Deionized water | 40 parts |

All the above respective components were mixed, and the resulting mixtures were adjusted to pH 5 to 7 with acetic acid, thereby preparing Inks C and D.

Using Inks C and D obtained in the above-described manner, the same patterns as those formed in Example 1 were printed on the same woven fabric as that used in Example 1 in the same manner as in Example 1. The thus-obtained print patches were then fixed by a thermosol treatment at 200° C. for 40 to 50 seconds. Thereafter, these patches were washed with a neutral detergent to evaluate them in color reproduction range in a region of from orange to scarlet and coloring stability. As a result, coloring in the region of from orange to scarlet was good, and coloring stability in the color-mixed portions was also good as shown in Table 1.

EXAMPLE 3

Preparation of Dye Dispersions V and VI

| | |
|---|---|
| β-Naphthalenesulfonic acid-formaldehyde condensate | 20 parts |
| Deionized water | 50 parts |
| Diethylene glycol | 10 parts |

The above components were mixed into a solution. To portions of this solution, were separately added 20 parts of the following disperse dyes to premix them for 30 minutes. Thereafter, the resulting premixes were subjected to a dispersion treatment under the following conditions:

Disperse dye: C.I. Disperse Orange 73 (for Dye Dispersion V) C.I. Disperse Red 348 (for Dye Dispersion VI)
Dispersing machine: Pearl Mill (manufactured by Ashizawa K.K.)
Grinding medium: glass beads (diameter: 1 mm)
Packing rate of the grinding medium: 50% (by volume)
Discharging rate: 100 ml/min.

The dispersions were further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersions V and VI.

Preparation of Inks E and F

| | |
|---|---|
| Dye Dispersion V or VI described above | 50 parts |
| Thiodiglycol | 23 parts |
| Diethylene glycol | 5 parts |
| Isopropyl alcohol | 3 parts |
| Deionized water | 19 parts |

All the above respective components were mixed, and the resulting mixtures were adjusted to pH 5 to 7 with acetic acid, thereby preparing Inks E and F.

A blended yarn fabric formed of 70% of polyester and 30% of cotton was immersed in a treatment solution (urea: 10%, carboxymethyl cellulose: 2%, water 88%) in advance, squeezed to a pickup of 30% and then dried. Using Inks E and F obtained in the above-described manner, the same patterns as those formed in Example 1 were printed on this woven fabric in the same manner as in Example 1. The thus-obtained print patches were then fixed by a steaming treatment at 160° C. for 6 to 8 minutes. Thereafter, these patches were washed with a neutral detergent to evaluate them in color reproduction range in a region of from orange to scarlet and coloring stability. As a result, coloring in the region of from orange to scarlet was good, and coloring stability in the color-mixed portions was also good as shown in Table 1.

Comparative Example 1

Preparation of Dye Dispersions VII and VIII

| | |
|---|---|
| Sodium polyoxyethylene alkyl ether sulfate | 5 parts |
| Deionized water | 75 parts |
| Diethylene glycol | 5 parts |

The above components were mixed into a solution. To portions of this solution, were separately added 15 parts of the following disperse dyes to premix them for 30 minutes. Thereafter, the resulting premixes were subjected to a dispersion treatment under the following conditions:

Disperse dye: C.I. Disperse Orange 61 (for Dye Dispersion VII) C.I. Disperse Red 113 (for Dye Dispersion VIII)
Dispersing machine: Sand Grinder (manufactured by Igarashi Kikai K.K.)
Grinding medium: zirconium beads (diameter: 1 mm)
Packing rate of the grinding medium: 50% (by volume)
Grinding time: 3 hours.

The dispersions were further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersions VII and VIII.

Preparation of Inks G and H

| | |
|---|---|
| Dye Dispersion VII or VIII described above | 40 parts |
| Thiodiglycol | 24 parts |
| Diethylene glycol | 11 parts |
| Deionized water | 25 parts |

All the above respective components were mixed, and the resulting mixtures were adjusted to pH 5 to 7 with acetic acid, thereby preparing Inks G and H.

Using Inks G and H obtained in the above-described manner, the same patterns as those formed in Example 1 were printed on the same woven fabric as that used in Example 1 in the same manner as in Example 1. The thus-obtained print patches were then fixed by a steaming treatment at 160° C. for 6 to 8 minutes. Thereafter, these patches were washed with a neutral detergent to evaluate them in color reproduction range in a region of from orange to scarlet and coloring stability. As a result, coloring in the region of from orange to scarlet was not very good, and coloring stability in the color-mixed portions was also poor as shown in Table 1.

Comparative Example 2

Preparation of Dye Dispersion IX

| | |
|---|---|
| Sodium polyoxyethylene alkyl ether sulfate | 5 parts |
| Deionized water | 75 parts |
| Diethylene glycol | 5 parts |

The above components were mixed into a solution. To this solution, were added 15 parts of the following disperse dye to premix them for 30 minutes. Thereafter, the resulting premix was subjected to a dispersion treatment under the following conditions:

Disperse dye: C.I. Disperse Orange 30 (for Dye Dispersion IX)
Dispersing machine: Sand Grinder (manufactured by Igarashi Kikai K.K.)
Grinding medium: zirconium beads (diameter: 1 mm)
Packing rate of the grinding medium: 50% (by volume)
Grinding time: 3 hours.

The dispersion was further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersion IX.

Preparation of Ink I

| | |
|---|---|
| Dye Dispersion IX described above | 40 parts |
| Thiodiglycol | 24 parts |
| Diethylene glycol | 11 parts |
| Deionized water | 25 parts |

All the above components were mixed, and the resulting mixture was adjusted to pH 5 to 7 with acetic acid, thereby preparing Ink I.

Using Ink I obtained in the above-described manner and Ink B used in Example 1, the same patterns as those formed in Example 1 were printed on the same woven fabric as that used in Example 1 in the same manner as in Example 1. The thus-obtained print patches were then fixed by a steaming treatment at 160° C. for 6 to 8 minutes. Thereafter, these patches were washed with a neutral detergent to evaluate them in color reproduction range in a region of from orange to scarlet and coloring stability. As a result, coloring in the region of from orange to scarlet was not very good, and coloring stability in the color-mixed portions was also poor as shown in Table 1.

Comparative Example 3

Preparation of Dye Dispersion X

| | |
|---|---|
| β-Naphthalenesulfonic acid-formaldehyde condensate | 20 parts |
| Deionized water | 50 parts |
| Diethylene glycol | 10 parts |

The above components were mixed into a solution. To this solution, were added 20 parts of the following disperse dye to premix them for 30 minutes. Thereafter, the resulting premix was subjected to a dispersion treatment under the following conditions:

Disperse dye: C.I. Disperse Yellow 56 (for Dye Dispersion X)

Dispersing machine: Pearl Mill (manufactured by Ashizawa K.K.)

Grinding medium: glass beads (diameter: 1 mm)

Packing rate of the grinding medium: 50% (by volume)

Discharging rate: 100 ml/min.

The dispersion was further subjected to a centrifugal treatment (12,000 rpm, 20 minutes) and then filtered through a Fluoropore Filter FP-250 (product of Sumitomo Electric Industries, Ltd.) to remove coarse particles, thereby obtaining Dye Dispersion X.

Preparation of Ink J

| | |
|---|---|
| Dye Dispersion X described above | 50 parts |
| Thiodiglycol | 23 parts |
| Diethylene glycol | 5 parts |
| Isopropyl alcohol | 3 parts |
| Deionized water | 19 parts |

All the above components were mixed, and the resulting mixture was adjusted to pH 5 to 7 with acetic acid, thereby preparing Ink J.

Using Ink J obtained in the above-described manner and Ink F used in Example 3, the same patterns as those formed in Example 1 were printed on the woven fabric used in Example 3 in the same manner as in Example 1. The thus-obtained print patches were then fixed by a steaming treatment at 160° C. for 6 to 8 minutes. Thereafter, these patches were washed with a neutral detergent to evaluate them in coloring ability and color depth. As a result, neither coloring in the region of from orange to scarlet nor coloring stability in the color-mixed portions was very good compared with Example 3, as shown in Table 1.

TABLE 1

| | Color reproduction range*1 in the region of from orange to scarlet | Coloring stability*2 |
|---|---|---|
| Ex. 1 | A | A |
| Ex. 2 | A | A |
| Ex. 3 | A | A |
| Comp. Ex. 1 | B | C |
| Comp. Ex. 2 | B | C |
| Comp. Ex. 3 | C | B |

*1: The 24 print patches obtained in each example were checked with the Munsell color standard to select colors classified in yellow-red and red (Note 1). The chromaticity a*, b* of each of the selected patches were measured by a spectrophotometer CM-2022 manufactured by MINOLTA CAMERA CO. LTD. to calculate C* (Note 2), thereby counting the number of patches having a C* value not lower than 55.

C* denotes chroma, and it is said that the chroma is higher and the range of color expression is wider as the C* value is greater.

A: More than 10 patches;

B: 5 to 10 patches; and

C: Less than 5 patches.

(Note 1):

The Munsell color system is a method for determining the color of an object by a color sample, in which hues are classified into 10 kinds such as yellow, yellow-red and red. In this classification, colors in the region of from orange to scarlet are included in yellow-red and red.

(Note 2):

$C^* = (a^*)^2 + (b^*)^2$.

*2: K/S values of the print patches subjected to the steaming treatment for 6 minutes and 8 minutes, respectively, as to Examples 1 and 3 and Comparative Examples 1 to 3, and K/S values of the print patches subjected to the thermosol treatment for 40 second and 50 seconds, respectively, as to Example 2 were measured to evaluate the coloring stability in terms of the remainder of the K/S values in the steaming treatment for 6 minutes and 8 minutes or in the thermosol treatment for 40 seconds in accordance with the following standard:

A: The remainder of K/S values was smaller than 1, which meant that the coloring stability does not vary depending upon the heating conditions;

B: The remainder of K/S values was 1 to 2, which meant that the coloring stability somewhat varies depending upon the heating conditions;

C: The remainder of K/S values was greater than 2, which meant that the coloring stability considerably varies depending upon the heating conditions $K/S = (1 - R)^2 / 2 \times R$ (R: reflectance at a maximum absorption wavelength).

EXAMPLE 4

Inks K and L were prepared in the same manner as in Example 1 except that C.I. Disperse Orange 29 in Example 1 was changed to C.I. Disperse Blue 368. Using the thus-obtained inks, print patches were prepared to evaluate them in color reproduction range in a from violescent to bluish region and coloring stability. As a result, coloring in the above region was good, and coloring stability in the color-mixed portions was also good, as shown in Table 2.

EXAMPLE 5

Inks M and N were prepared in the same manner as in Example 2 except that the disperse dyes in Example 2 were changed respectively to C.I. Disperse Red 159 and C.I. Disperse Blue 267. Using the thus-obtained inks, print patches were prepared to evaluate them in color reproduction range in a from violescent to bluish region and coloring stability. As a result, coloring in the above region was good, and coloring stability in the color-mixed portions was also good as shown in Table 2.

EXAMPLE 6

Inks O and P were prepared in the same manner as in Example 3 except that the disperse dyes in Example 3 were changed respectively to C.I. Disperse Red 92 and C.I.

Disperse Blue 287. Using the thus-obtained inks, print patches were prepared to evaluate them in color reproduction range in a from violescent to bluish region and coloring stability. As a result, coloring in the above region was good, and coloring stability in the color-mixed portions was also good as shown in Table 2.

Comparative Example 4

Inks were prepared in the same manner as in Example 4 except that the disperse dyes in Example 4 were changed respectively to C.I. Disperse Red 43 and C.I. Disperse Blue 81:1. Using the thus-obtained inks, print patches were prepared to evaluate them in color reproduction range in a from violescent to bluish region and coloring stability. As a result, coloring in the above region was not very good, and coloring stability in the color-mixed portions was poor as shown in Table 2.

Comparative Example 5

An ink was prepared in the same manner as in Example 4 except that the disperse dyes in Example 4 were changed to C.I. Disperse Red 188 alone. Using the thus-obtained ink, print patches were prepared to evaluate them in color reproduction range in a from violescent to bluish region and coloring stability. As a result, coloring in the above region was not very good, and coloring stability in the color-mixed portions was also poor as shown in Table 2.

Comparative Example 6

An ink was prepared in the same manner as in Example 4 except that the disperse dyes in Example 6 were changed to C.I. Disperse Blue 7 alone. Using the thus-obtained ink, print patches were prepared to evaluate them in color reproduction range in a from violescent to bluish region and coloring stability. As a result, coloring in the above region was not very good, and coloring stability in the color-mixed portions was also poor as shown in Table 2.

TABLE 2

| | Color reproduction range*1 in the region of from violescent to bluish | Coloring stability*2 |
|---|---|---|
| Ex. 4 | A | A |
| Ex. 5 | A | A |
| Ex. 6 | A | A |
| Comp. Ex. 4 | B | C |
| Comp. Ex. 5 | B | C |
| Comp. Ex. 6 | C | B |

*1: The 24 print patches obtained in each example were checked with the Munsell color standard to select colors classified in purple and purple-blue (Note 1). The chromaticity a*, b* of each of the selected patches was measured by a spectrophotometer CM-2022 manufactured by MINOLTA CAMERA CO. LTD. to calculate C* (Note 2), thereby counting the number of patches having a C* value not lower than 55.
C* denotes chroma, and it is said that the chroma is higher and the range of color expression is wider as the C* value is greater.
A: More than 10 patches;
B: 5 to 10 patches; and
C: Less than 5 patches.
(Note 1):
The Munsell color system is a method for determining the color of an object by a color sample, which hues are classified into 10 kinds such as blue, purple and purple-blue. In this classification, colors in the region of from violet to the blue line are included in purple and purple-blue.
(Note 2):
$C^* = (a^*)^2 + (b^*)^2$.

TABLE 2-continued

| | Color reproduction range*1 in the region of from violescent to bluish | Coloring stability*2 |
|---|---|---|

*2: K/S values of the print patches subjected to the steaming treatment for 6 minutes and 8 minutes, respectively, as to Examples 4 and 6 and Comparative Examples 4 to 6, and K/S values of the print patches subjected to the thermosol treatment for 40 seconds and 50 seconds, respectively, as to Example 5 were measured to evaluate the coloring stability in terms of the remainder of the K/S values in the steaming treatment for 6 minutes and 8 minutes or in the thermosol treatment for 40 seconds and 50 seconds in accordance with the following standard:
A: The remainder of K/S values was smaller than 1, which meant that the coloring stability does not vary depending upon the heating conditions;
B: The remainder of K/S values was 1 to 2, which meant that the coloring stability somewhat varies depending upon the heating conditions;
C: The remainder of K/S values was greater than 2, which meant that the coloring stability considerably varies depending upon the heating conditions.
$K/S = (1 - R)^2 / 2 \times R$ (R: reflectance at a maximum absorption wavelength).

According to the present invention, as described above, prints wide in color reproduction range in a region of from orange to scarlet and excellent in production stability can be obtained.

According to the present invention, prints good in color reproducibility in a region of from violet to blue and excellent in production stability can also be obtained.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A process for forming a cloth having a dyed part in yellow-red or red according to the Munsell color system, comprising the steps of:

(a) providing a cloth comprising fibers dyeable with disperse dyes;

(b) applying an orange ink and a red ink respectively to a part where the dyed part is to be formed on the cloth with an ink-jet system so that at least a part of the inks overlaps each other on the cloth to form a color-mixed portion;

(c) subjecting the cloth resulting from step (b) to a heat treatment; and (d) washing the cloth resulting from step (c), wherein each of the orange and red inks comprises a coloring matter, a compound for dispersing the coloring matter and an aqueous liquid medium, the orange ink comprises, as the coloring matter, at least one selected from the group consisting of C.I. Disperse Orange 29, 49 and 73, and the red ink comprises, as the coloring matter, at least one selected from the group consisting of C.I. Disperse Red 86, 88, 92, 126, 135, 145, 152, 159, 177, 181, 206, 283 and 348.

2. A process for forming a cloth having a dyed part in purple or purple-blue according to the Munsell color system, comprising the steps of:

(a) providing a cloth comprising fibers dyeable with disperse dyes;

(b) applying a red ink and a blue ink respectively to a part where the dyed part is to be formed on the cloth with an ink-jet system so that at least a part of the inks overlaps each other on the cloth to form a color-mixed portion;

(c) subjecting the cloth resulting from step (b) to a heat treatment; and (d) washing the cloth resulting from step (c), wherein each of the red and blue inks comprises a disperse dye, a compound for dispersing the disperse dye and an aqueous liquid medium, and wherein the red ink comprises, as the disperse dye, at least one selected from the group consisting of C.I. Disperse Red 86, 88, 92, 126, 135, 145, 152, 159, 177, 181, 206, 283 and 348, and the blue ink comprises, as the disperse dye, at least one selected from the group consisting of C.I. Disperse Blue 56, 73, 128, 154, 165, 183, 201, 214, 224, 257, 266, 267, 287 and 368.

3. The process of claim 1 or 2, wherein the cloth comprises polyester fibers.

4. The process of claim 1 or 2, wherein the heat treatment is a high-temperature steaming process or a thermosol process.

5. The process of claim 1 or 2, wherein the total amount of each coloring matter applied in the color-mixed portion is in the range of from 0.01 to 1 mg/cm$^2$.

6. The process of claim 5, wherein the total amount of each coloring matter applied in the color-mixed portion is in the range of from 0.015 to 0.6 mg/cm$^2$.

7. The process of claim 6, wherein the total amount of each coloring matter applied in the color-mixed portion is in the range of from 0.02 to 0.4 mg/cm$^2$.

8. The process of claim 1 or 2, wherein the ink-jet system is a system in which the inks are ejected using thermal energy.

9. The process of claim 1 or 2, wherein the inks are applied to the cloth at ejection velocities of from 5 to 20 m/sec.

10. The process of claim 1 or 2, which further comprises a step of treating the cloth with a solution containing at least one material selected from the group consisting of urea, a water-soluble polymer, and a water-soluble metal salt, between steps (a) and (b).

11. The process of claim 10, wherein the water-soluble polymer is a material selected from the group consisting of starch, carboxymethyl cellulose, methyl cellulose, hydroxyethyl cellulose, sodium alginate, gum arabic, locust bean gum, tragacanth gum, guar gum, tamarind seed, gelatin, casein, polyvinyl alcohol, polyethylene oxide, water-soluble acrylic polymers and water-soluble maleic anhydride polymers.

12. The process of claim 10, wherein the water-soluble metal salt includes sodium chloride, sodium sulfate, potassium chloride, sodium acetate, calcium chloride, or magnesium chloride.

13. The process of claim 10, wherein said material is contained in an amount of 0.01 to 20% by weight in the cloth.

14. A cloth having a printed part where an orange dye and a red dye overlap to form a color-mixed portion, the printed part being in yellow-red or red according to the Munsell color system, wherein the orange dye is selected from the group consisting of C.I. Disperse Orange 29, 49 and 73, and the red dye is selected from the group consisting of C.I. Disperse Red 86, 88, 92, 126, 135, 145, 152, 159, 177, 181, 206, 283 and 348.

15. A cloth having a printed part where a red dye and a blue dye overlap to form a color-mixed portion, the printed part being in purple to purple-blue according to the Munsell color system, wherein the red dye is selected from the group consisting of C.I. Disperse Red 86, 88, 92, 126, 135, 145, 152, 159, 177, 181, 206, 283 and 348, and the blue dye is selected from the group consisting of C.I. Disperse Blue 56, 73, 128, 154, 165, 183, 201, 214, 224, 257, 266, 267, 287 and 368.

16. The cloth of claim 14 or 15, wherein the cloth comprises polyester fibers.

17. The cloth of claim 14 or 15, wherein the total amount of each coloring matter applied in the color-mixed portion is in the range of from 0.01 to 1 mg/cm$^2$.

18. The cloth of claim 17, wherein the total amount of each coloring matter applied in the color-mixed portion is in the range of from 0.015 to 0.6 mg/cm$^2$.

19. The cloth of claim 18, wherein the total amount of each coloring matter applied in the color-mixed portion is in the range of from 0.02 to 0.4 mg/cm$^2$.

20. A process for stabilizing quality of a cloth having a part in yellow-red or red according to the Munsell color system, the part being produced by the steps of;

(i) applying a first ink comprising an orange dye to the cloth;

(ii) applying a second ink comprising a red dye to the cloth;

(iii) heating the cloth to which the first and the second ink are applied in steps (i) and (ii) to fix each of the dyes to the cloth; and (iv) washing the cloth resulting from step (iii), steps (i) and (ii) being conducted so that the first and the second ink are mixed to form the part, wherein the orange dye is selected from the group consisting of C.I. Disperse Orange 29, 49 and 73, and the red dye is selected from the group consisting of C.I. Disperse Red 86, 88, 92, 126, 135, 145, 152, 159, 177, 181, 206, 283 and 348.

21. A process for stabilizing quality of a cloth having a part in purple or purple-blue according to the Munsell color system, the part being produced by the steps of:

(i) applying a first ink comprising a red dye to the cloth;

(ii) applying a second ink comprising a blue dye to the cloth;

(iii) heating the cloth to which the first and the second ink are applied in steps (i) and (ii) to fix the dyes to the cloth; and (iv) washing the cloth resulting from step (iii), steps (i) and (ii) being conducted so that the first and the second ink are mixed to form the part, wherein the red dye is selected from the group consisting of C.I. Disperse Red 86, 88, 92, 126, 135, 145, 152, 159, 177, 181, 206, 283, and 348, and the blue dye is selected from the group consisting of C.I. Disperse Blue 56, 73, 128, 154, 165, 183, 201, 214, 224, 257, 266, 267, 287, and 368.

22. The process according to claim 20 or 21, wherein the total amount of each of the disperse dyes in the part is in a range of from 0.01 to 1 mg/cm$^2$.

* * * * *

UNITED STATES PATENT AND TRADEMARK OFFICE

CERTIFICATE OF CORRECTION

PATENT NO. : 6,426,766 B1
DATED : July 30, 2002
INVENTOR(S) : Koromo Shirota et al.

It is certified that error appears in the above-identified patent and that said Letters Patent is hereby corrected as shown below:

Title page,
Item [56], References Cited, FOREIGN PATENT DOCUMENTS,
"JP 62243890" should read -- JP 62-243890 --.
"JP 61118477" should read -- JP 61-118477 --.
OTHER PUBLICATIONS,
Insert -- Communication pursuant to Article 96(2) EPC, dated May 2, 2001. --

Column 2,
Line 2, "every" should read -- for every --.
Line 5, "as of" should read -- of --.
Line 16, "in the" should read -- in --.
Line 17, "of a" should read -- of --.

Column 6,
Line 6, "a orange" should read -- an orange --.
Line 13, "orange" should read -- Orange --.

Column 13,
Line 27, "water" should read -- water: --.

Column 16,
Line 25, "$C^*=(a^*)^2+(b^*)^2$." should read -- $C^*=\sqrt{(a^*)^2+(b^*)^2}$. --.
Line 28, "second" should read -- seconds --.
Line 30, "seconds" should read -- seconds and 50 seconds --.
Line 45, "in a" should read -- in a region --.
Line 46, "region" should be deleted.
Line 56, "in a" should read -- in a region -- and "region and" should read -- and --.

Column 17,
Lines 1, 24 and 35, "in a" should read -- in a region -- and "region and" should read -- and --.
Line 12, "in a" should read -- in a region --.
Line 13, "region" should be deleted.

UNITED STATES PATENT AND TRADEMARK OFFICE

CERTIFICATE OF CORRECTION

PATENT NO. : 6,426,766 B1
DATED : July 30, 2002
INVENTOR(S) : Koromo Shirota et al.

It is certified that error appears in the above-identified patent and that said Letters Patent is hereby corrected as shown below:

Column 17 cont'd,
Line 66, "$C^*=(a^*)^2+(b^*)^2$." should read -- $C^*=\sqrt{(a^*)^2+(b^*)^2}$. --.

Signed and Sealed this

Twenty-second Day of July, 2003

JAMES E. ROGAN
*Director of the United States Patent and Trademark Office*